US009146501B2

(12) United States Patent
Kikuchi et al.

(10) Patent No.: US 9,146,501 B2
(45) Date of Patent: Sep. 29, 2015

(54) TONER CARTRIDGE AND IMAGE FORMING APPARATUS INCORPORATING SAME

(71) Applicants: Teppei Kikuchi, Kanagawa (JP); Hideki Kosugi, Kanagawa (JP); Tatsuya Kubo, Kanagawa (JP); Akira Fujimori, Kanagawa (JP); Kentaro Nodera, Kanagawa (JP); Shinnosuke Koshizuka, Kanagawa (JP)

(72) Inventors: Teppei Kikuchi, Kanagawa (JP); Hideki Kosugi, Kanagawa (JP); Tatsuya Kubo, Kanagawa (JP); Akira Fujimori, Kanagawa (JP); Kentaro Nodera, Kanagawa (JP); Shinnosuke Koshizuka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/260,547

(22) Filed: Apr. 24, 2014

(65) Prior Publication Data

US 2014/0321886 A1 Oct. 30, 2014

(30) Foreign Application Priority Data

Apr. 25, 2013 (JP) ..... 2013-092129
Dec. 20, 2013 (JP) ..... 2013-264285

(51) Int. Cl.
*G03G 15/08* (2006.01)

(52) U.S. Cl.
CPC ..... *G03G 15/0889* (2013.01); *G03G 15/0865* (2013.01); *G03G 15/0875* (2013.01); *G03G 15/0832* (2013.01); *G03G 15/0834* (2013.01); *G03G 2215/0665* (2013.01); *G03G 2215/085* (2013.01); *G03G 2215/0819* (2013.01)

(58) Field of Classification Search
CPC ..... G03G 15/08
USPC ..... 399/263
See application file for complete search history.

(56) References Cited

U.S. PATENT DOCUMENTS

| | | | | |
|---|---|---|---|---|
| 8,126,374 | B2 | 2/2012 | Lee | |
| 2009/0060588 | A1 | 3/2009 | Tanaka | |
| 2010/0202803 | A1 | 8/2010 | Sato et al. | |
| 2011/0176834 | A1* | 7/2011 | Lee | 399/224 |
| 2012/0027466 | A1* | 2/2012 | Nakayama et al. | 399/256 |
| 2012/0039627 | A1* | 2/2012 | Kubo et al. | 399/111 |
| 2012/0051797 | A1* | 3/2012 | Suzuki et al. | 399/272 |
| 2012/0163875 | A1* | 6/2012 | Tateyama et al. | 399/257 |
| 2013/0051863 | A1* | 2/2013 | Koshizuka et al. | 399/258 |
| 2013/0243491 | A1 | 9/2013 | Nodera et al. | |

(Continued)

FOREIGN PATENT DOCUMENTS

| | | |
|---|---|---|
| JP | 7-49613 A | 2/1995 |
| JP | 2001-201931 | 7/2001 |

(Continued)

OTHER PUBLICATIONS

Extended European Search Report issued Jan. 5, 2014 in Patent Application No. 14165631.4.

*Primary Examiner* — Clayton E Laballe
*Assistant Examiner* — Kevin Butler
(74) *Attorney, Agent, or Firm* — Oblon, McClelland, Maier & Neustadt, L.L.P.

(57) ABSTRACT

A toner cartridge includes a toner container to store toner and two rotary agitation members to rotate to agitate toner in the toner container. The toner container has two arc-shaped portions adjacent to each other at an inner bottom wall of the toner container. The two rotary agitation members has edges to rotate along the two arc-shaped portions with rotation phases thereof shifted from each other. The two rotary agitation members are placed with rotation trajectories thereof partially overlapping each other.

11 Claims, 12 Drawing Sheets

(56) References Cited

U.S. PATENT DOCUMENTS

| | | | | |
|---|---|---|---|---|
| 2013/0315636 | A1* | 11/2013 | Takayama et al. | 399/272 |
| 2014/0003843 | A1 | 1/2014 | Suzuki et al. | |
| 2014/0321886 | A1* | 10/2014 | Kikuchi et al. | 399/263 |

FOREIGN PATENT DOCUMENTS

| | | |
|---|---|---|
| JP | 2006-208433 | 8/2006 |
| JP | 2008-197636 | 8/2008 |

* cited by examiner

TONER CARTRIDGE AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application Nos. 2013-092129, filed on Apr. 25, 2013, and 2013-264285, filed on Dec. 20, 2013, in the Japan Patent Office, the entire disclosure of each of which is hereby incorporated by reference herein.

BACKGROUND

1. Technical Field

Exemplary embodiments of this disclosure relate to a toner cartridge to store powder such as toner, and to an image forming apparatus incorporating the toner cartridge.

2. Description of the Related Art

Image forming apparatuses are used as, for example, copiers, printers, facsimile machines, and multi-functional devices having at least one of the foregoing capabilities. As one type of image forming apparatus, electrophotographic image forming apparatuses are known. Such an electrophotographic image forming apparatus may have a toner cartridge to supply toner to form a toner image. The toner cartridge is replaced when toner is exhausted due to toner consumption by printing (see, for example, U.S. Pat. No. 812,637-B, JP-2001-201931-A, JP-2006-208433-A, and JP-2008-197636-A). It is therefore preferable to increase the toner capacity of a toner cartridge in order to prolong the product life. However, an increase in the toner capacity typically accompanies an increase in size of the toner cartridge and also an increase in size of an image forming apparatus in which the toner cartridge is mounted. Accordingly, there is a demand for a toner cartridge having a large toner capacity and a space-saving design (small wasteful space).

When a large amount of toner remains in a container before replacement of a toner cartridge, this means that an actual toner capacity is decreased by the amount of the residual toner quantity. Therefore, there is a demand for reduction in residual toner quantity in addition to the enlargement of toner capacity.

On the other hand, a toner cartridge having a laterally long cross section in which two rotary agitation members are provided has been proposed (see, for example, U.S. Pat. No. 812,637-B) to enlarge the capacity by increasing a lateral width dimension in a cross section of a toner container of the toner cartridge. In this type, it is to be noted that rotation trajectories of the two rotary agitation members may be placed apart from each other, or a toner transport screw may be placed in a space between the two rotary agitation members or a space at an end of the toner container.

Such a toner cartridge in which two rotary agitation members are placed apart from each other, however, has a relatively large size of a toner container in the lateral width direction viewed from a rotation axis direction of the rotary agitation members.

BRIEF SUMMARY

In light of the above-described situation, at least one embodiment of this disclosure provides an improved toner cartridge includes a toner container to store toner and two rotary agitation members to rotate to agitate toner in the toner container. The toner container has two arc-shaped portions adjacent to each other at an inner bottom wall of the toner container. The two rotary agitation members has edges to rotate along the two arc-shaped portions with rotation phases thereof shifted from each other. The two rotary agitation members are placed with rotation trajectories thereof partially overlapping each other.

At least one embodiment of this disclosure provides an improved image forming apparatus including a toner cartridge. The toner cartridge includes a toner container to store toner and two rotary agitation members to rotate to agitate toner in the toner container. The toner container has two arc-shaped portions adjacent to each other at an inner bottom wall of the toner container. The two rotary agitation members has edges to rotate along the two arc-shaped portions with rotation phases thereof shifted from each other. The two rotary agitation members are placed with rotation trajectories thereof partially overlapping each other.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
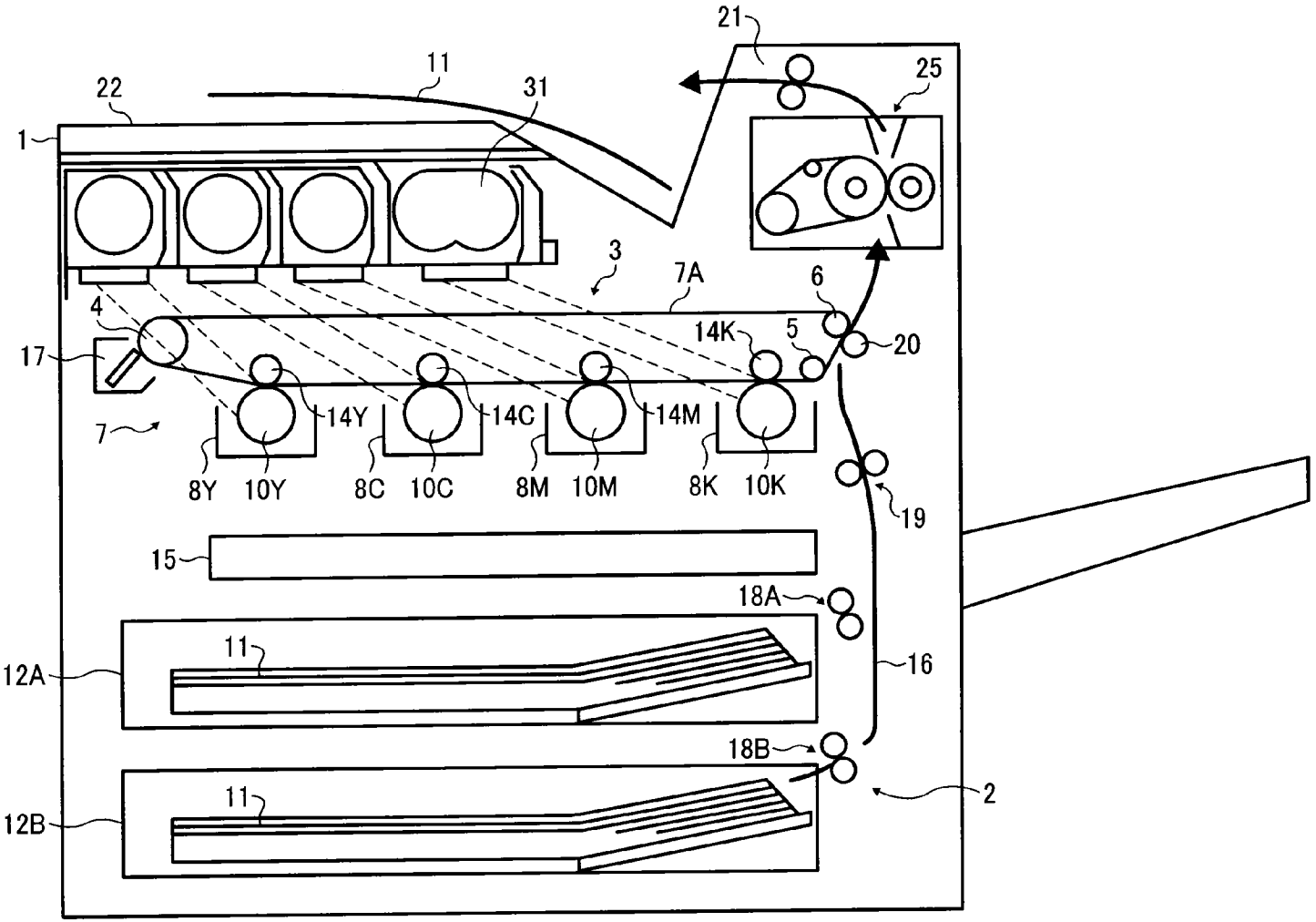
FIG. 1 is a schematic view of an image forming apparatus according to an embodiment of the present disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the disclosure and all of the components or elements described in the exemplary embodiments of this disclosure are not necessarily indispensable.

Below, embodiments of this disclosure are given with reference to FIGS. 1 to 12.

(Image Forming Apparatus)

FIG. 1 is a view of a basic configuration of an image forming apparatus, which functions as an electrophotographic printer, according to an embodiment of this disclosure.

The image forming apparatus illustrated in FIG. 1 includes a sheet feeding unit 2 and an image forming unit 3. The sheet feeding unit 2 includes a plurality of feed trays 12A and 12B to store sheets 11 as recording materials and is disposed at a lower part of an apparatus body 1 of an image forming apparatus. The image forming unit 3 is disposed at an upper part of the apparatus body 1 of the image forming apparatus. The image forming unit 3 included imaging units 8Y, 8C, 8M and 8K and an intermediate transfer unit 7. The imaging units 8Y, 8C, 8M and 8K have photoreceptor drums 10Y, 10C, 10M and 10K, respectively, as image bearing bodies. The intermediate transfer unit 7 has an intermediate transfer belt 7A serving as an intermediate transfer body wound around a plurality of rollers 4, 5 and 6. The image forming unit 3 further includes a writing unit 15 and a fixing device 25. The writing unit 15 carries out optical writing to each photoreceptor drum. The fixing device 25 fixes a non-fixed toner image T onto a sheet 11. A conveyance path 16 includes conveyance rollers to convey a sheet 11 and is formed from the sheet feeding unit 2 to the fixing device 25.

The imaging units 8Y, 8C, 8M and 8K include the photoreceptor drums 10Y, 10C, 10M and 10K, respectively, and further include charging devices, development devices, and cleaning devices around the photoreceptor drums. The imaging units 8Y, 8C, 8M and 8K are detachably mounted to the apparatus body 1 of the image forming apparatus as a process cartridge. The development devices respectively store toner of yellow, cyan, magenta and black, and are configured so that toner for refill corresponding to each color is supplied from a discharge port of a toner cartridge 31 via a toner transport path to each development device when toner decreases. The discharge port is located at an upper part of the apparatus body 1 of the image forming apparatus.

The intermediate transfer belt 7A is placed opposing each photoreceptor drum, and is configured to rotate counterclockwise in FIG. 1. Transfer rollers 14 serving as a primary transfer unit are placed at an inner side of the intermediate transfer belt 7A opposed to each photoreceptor drum, so that transfer bias for primary transfer is applied. A belt cleaning device 17 is disposed at a position opposed to the roller 4. The intermediate transfer belt 7A, the plurality of rollers 4 to 6, the transfer rollers 14 and the belt cleaning device 17 are formed as an integral unit, and are detachably mounted to the apparatus body 1 of the image forming apparatus.

A transfer roller 20 as a secondary transfer unit to which secondary transfer bias is to be applied contacts with the intermediate transfer belt 7A at a position opposed to the roller 6. The transfer roller 20 and a part of the intermediate transfer belt 7A are disposed to face a conveyance path.

The writing unit 15 irradiates the surface of each photoreceptor drum with an optically modulated laser beam so as to form a latent image of each color on the surface of each photoreceptor drum. The writing unit 15 is placed below the imaging units 8Y, 8C, 8M and 8K, so that laser irradiation is carried out from a lower part of the apparatus to an upper part of the apparatus.

When an image forming operation is started, the photoreceptor drums 10Y, 10C, 10M and 10K of the respective imaging units are driven to rotate clockwise by a driving unit, and the surface of each photoreceptor drum is charged uniformly by each charging device to a predetermined polarity. The charged surface of each photoreceptor drum is irradiated with a laser beam from the writing unit 15, and an electrostatic latent image is formed on each surface. Here, image information to be used for exposure to each photoreceptor drum is monochrome image information which is obtained by separating a desired full color image into color information of yellow, cyan, magenta and black. When an electrostatic latent image formed in such a manner passes between each photoreceptor drum and each development device, a visible image is formed as a toner image by toner in each development device.

When the intermediate transfer belt 7A is moved in a counterclockwise direction by a driving unit, an yellow toner image, which has been formed by the imaging unit 8Y that is positioned at the most upstream side in a belt movement direction and is provided with a development device having yellow toner, is transferred by a transfer roller 14Y. A cyan toner image, a magenta toner image and a black toner image are transferred sequentially by transfer rollers 14C, 14M and 14K so as to overlap the yellow toner image, and the intermediate transfer belt 7A carries a full color toner image on the surface thereof.

Residual toner adhering to the surface of each photoreceptor drum after transfer of a toner image is removed from the surface of the photoreceptor drum by each cleaning device, and the surface is neutralized by a neutralization device, so that the surface potential is initialized and prepared for next image formation.

On the other hand, by driving a sheet feed roller 18A or a sheet feed roller 18B to rotate, a sheet 11 is fed from the sheet feeding unit 2 and is sent into the conveyance path 16. The sent sheet 11 is fed to a part where the roller 6 and the transfer roller 20 are opposed to each other while adjusting sheet feed timing with a registration roller pair 19 which is disposed on the conveyance path 16 at a sheet feed side of the secondary transfer roller 20. At this time, transfer voltage of a polarity opposite to the toner charging polarity of a toner image on the surface of the intermediate transfer belt is applied to the transfer rollers, and the toner image on the surface of the intermediate transfer belt 7A is transferred collectively onto the sheet 11.

The sheet 11, onto which the toner image has been transferred, is conveyed to the fixing device 25, and heat and pressure are applied to the sheet 11 while the sheet 11 passes through the fixing device 25, so that the toner image is melted and fixed onto the sheet 11. The sheet 11, onto which the toner image has been fixed, is conveyed toward a discharging member 21 positioned at a terminal of a sheet conveyance path, and is discharged from the discharging member 21 to a discharge tray 22 which functions as a discharge unit provided at an upper part of the apparatus body 1 of the image forming apparatus. After toner is transferred to the sheet 11, residual toner on the intermediate transfer belt 7A is cleaned by the cleaning device 17.

Figure 2:
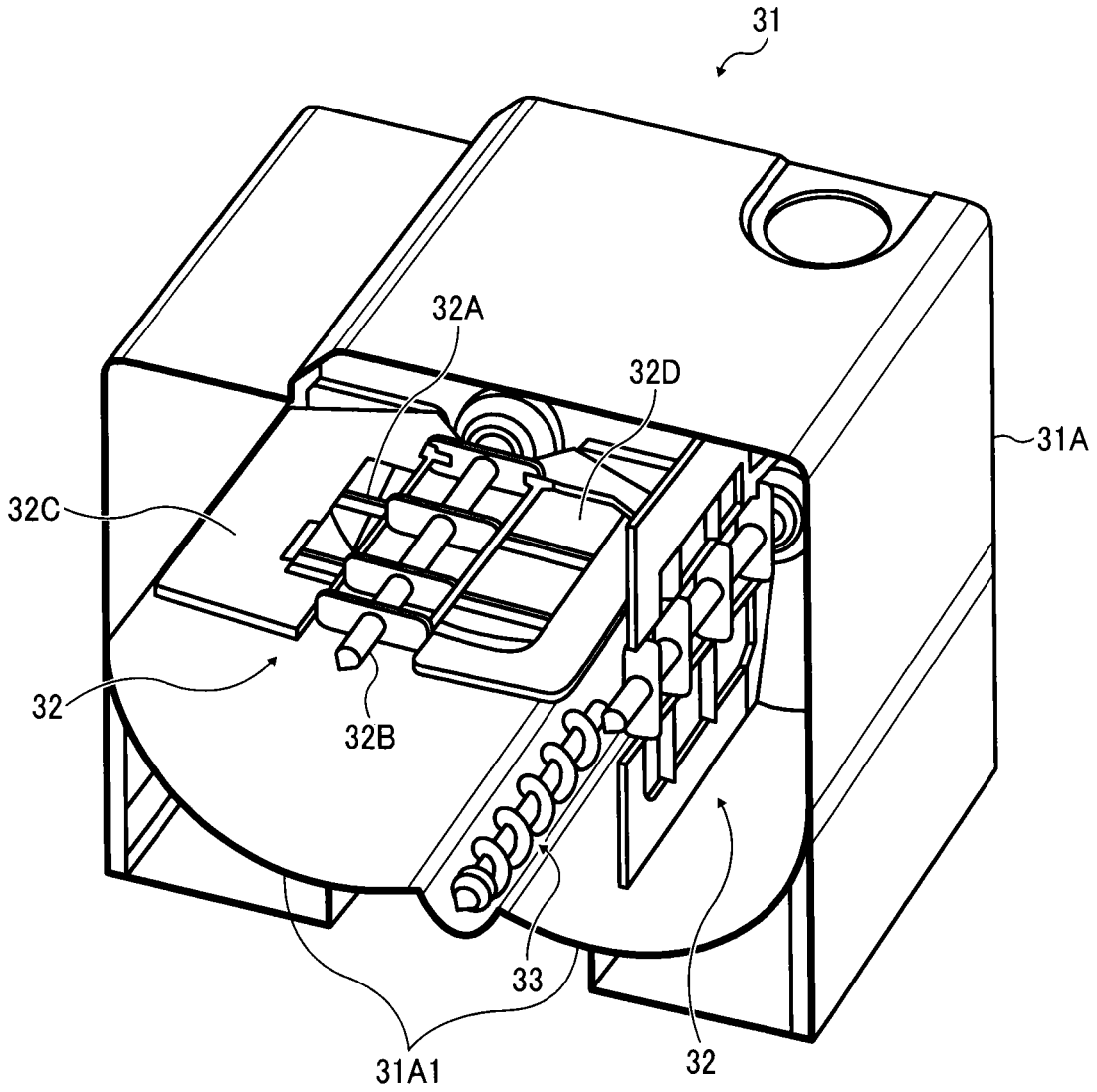
FIG. 2 is a cross-sectional perspective view of a toner cartridge according to an embodiment of the present disclosure.

Regarding the image forming apparatus illustrated in FIG. 1, technology of this embodiment is used for a configuration of the toner cartridge 31. In other words, the electrophotographic image forming apparatus according to this embodiment is characterized in that a toner cartridge 31 of a laterally long two-axis type illustrated in FIG. 2 is used as the toner cartridge 31 in the image forming apparatus illustrated in FIG. 1. The toner cartridge of the laterally long two-axis type is a toner cartridge in which two rotary agitation members to rotate about rotary shafts are provided adjacent to each other and which is provided with a toner container having a lateral width larger than a vertical length.

Below, the toner cartridge according to an embodiment of this disclosure is described with reference to FIG. 2.

In this embodiment, a toner cartridge 31 has a toner container 31A which is a toner containing member to be filled with toner, a toner transport screw 33 serving as a toner transport member installed in the toner container 31A, and two rotary agitation members 32. The two rotary agitation members 32 agitate toner by rotating integrally about rigid shaft members 32B serving as rotary shafts disposed parallel to the toner transport screw 33 in the toner container 31A. An inner bottom wall of the toner container 31A has two arc-shaped portions 31A1 adjacent to each other along rotation trajectories of the rotary agitation members 32. The two rotary agitation members 32 are provided to agitate toner in the toner container 31A and transport toner to the toner transport screw 33. Each rotary agitation member 32 has a rigid shaft member 32B, a rigid frame member 32A which is formed integrally with the rigid shaft member 32B, and a flexible blade member 32C to be attached to a terminal of the rigid frame member 32A. The rigid frame member 32A and the flexible blade member 32C are formed so that the rotation trajectory is centered at the rigid shaft member 32B, and are formed in a two-blade form in which two blades are provided at an interval of 180° so as to protrude bidirectionally to be axisymmetric with respect to the rigid shaft member 32B in a direction perpendicular to the axis of the rigid shaft member 32B. Moreover, the rotary agitation member 32 may be formed in a single blade form so as to protrude in only one direction from the rigid shaft member 32B. In the rotary agitation member 32, the rigid frame member 32A is provided with openings 32D, so that toner can pass through the openings. The length of the flexible blade member 32C can be set so that an edge thereof contacts the inner bottom wall of the toner container 31A during rotation. In the case of a single blade form, toner may be agitated and transported with the number of revolution larger than the case of a two-blade form. When the flexible blade member 32C provided on the rigid frame member 32A rotates with an edge thereof being in contact with the inner bottom wall of the toner container 31A, there provides effects that adhering toner can be scraped out and residual toner decreases.

Although it is simple and preferable to integrally form the rigid shaft member 32B and the rigid frame member 32A with metal or resin, other materials or other manufacturing methods may be used. The flexible blade member 32C is formed with a material having low rigidity, e.g., a flexible member such as polyethylene terephthalate (PET), polyethylene (PE), polypropylene (PP), polyphenylene sulfide (PPS) or a polyurethane sheet. It is preferable that the thickness is approximately 50 μm to approximately 500 μm, and it is especially suitable that the thickness is 50 μm to 300 μm. Since the flexible blade member 32C is flexible, rotation is not disturbed even in a state where an edge contacts the inner bottom wall of the toner container 31A.

Figure 3:
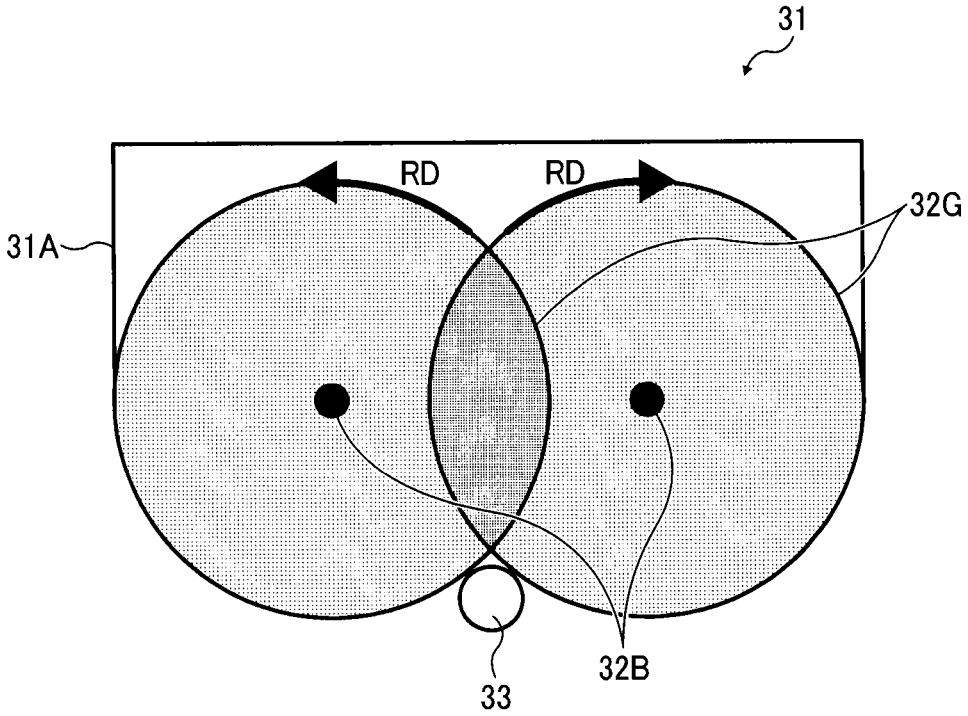
FIG. 3 is a schematic view of two rotary agitation members and a toner transport screw of the toner cartridge.

FIG. 3 is a view for illustrating arrangement of the two rotary agitation members 32 and the toner transport screw 33 in the toner container 31A, rotation trajectories 32G, and a state of the rotary agitation members 32 in respective rotation directions indicated by arrows RD. The toner transport screw 33, which is located on a bottom face of the container so as to supply toner from the discharge port to the development device, is provided outside the rotation trajectories of the rotary agitation members 32 in order to avoid contact with the rotary agitation members 32. This forms a convex at an external form of the toner cartridge 31, and sometimes forms a wasteful space around the convex. In a state where a gap exists between the rotation trajectories 32G of the rotary agitation members 32 and the toner container 31A when the rotary agitation members 32 transport toner in the toner container 31A to the toner transport screw 33, toner remains in the gap area and a large quantity of residuals sometimes exists at the time of replacement of the toner cartridge. When a gap between the rotation trajectories 32G of the rotary agitation members 32 and the toner container 31A is downsized in order to prevent such a state, the bottom face of the toner container 31A becomes semicircular and sometimes tends to form a dead space. However, by placing the toner transport screw 33 in a space between two rotation trajectories of the two rotary agitation members 32 and outside the rotation trajectories 32G, it is possible to downsize a convex to be formed at an external form of the toner container 31A, and it becomes possible to decrease a wasteful space around the convex. Although rotation trajectories 32G of the two rotary agitation members 32 overlap each other, the members do not interfere each other since there is a difference of approximately 90° between rotation phases of the two rotary agitation members 32. The rotation phase difference may be a phase difference other than approximately 90°, as long as the phase difference enables prevention of the two rotary agitation members 32 from interfacing (colliding with) each other in the rotation trajectories.

Toner inside the toner cartridge 31 is agitated by the two rotary agitation members 32 and transported to the toner transport screw 33. The two rotary agitation members 32 rotate in the directions RD opposite to each other, so as to agitate toner in the toner container efficiently and prevent toner from agglomerating. Moreover, the rotation directions of the two rotary agitation members 32 may be a combination of a clockwise direction and a counterclockwise direction, as long as the rotation directions enable movement of toner from an upper end corner side of the toner container 31A. Especially, by rotating a left rotary agitation member in a counterclockwise direction and rotating a right rotary agitation member in a clockwise direction in FIG. 3, it is possible to agitate toner efficiently while preventing toner from agglomerating and to transport toner to the toner transport screw 33. By providing two rotary agitation members 32, toner agitation capability and toner transport capability are improved, and it becomes possible to prevent toner from agglomerating.

Furthermore, the rotation directions of the two rotary agitation members 32 may be the same direction of a clockwise direction or a counterclockwise direction, as long as the direction enables movement of toner from an upper end corner side of the toner container 31A. Even with rotation directions of the same direction, it is possible to agitate toner efficiently while preventing toner from agglomerating and to transport toner to the toner transport screw 33.

The toner transport screw 33 transports toner via a toner discharge port, to sub-hoppers or the development devices, which are placed below the toner cartridge 31. In the toner cartridge 31, a space sometimes exists in the toner cartridge container in the image forming apparatus in a lateral width direction in a cross section of the toner container 31A viewed from the rotation axis direction of the rotary agitation members 32, i.e., a direction perpendicular to the paper face of FIG. 3, and the toner container 31A can be enlarged using the space. In this embodiment, the rotary agitation members 32 transport toner existing in the rotation trajectories thereof and in the vicinity of the rotation trajectories, and it is possible to increase the lateral width dimension of the toner container 31A without limiting the dimension of the lateral width in a cross section of the toner container 31A to be equal to or smaller than the vertical length. This enables effective utilization of a space where the toner cartridge 31 is to be located. Since B (black) toner consumption is generally larger than toner consumption of colors of Y (yellow), M (magenta) and C (cyan), significant benefits can be obtained by increasing even only the lateral width dimension of the B (black) toner cartridge so as to increase the toner storage capacity.

The toner cartridge 31 according to this embodiment is placed so that the rotation trajectories 32G of the two rotary agitation members 32 partially overlap each other, and the lateral width dimension in a cross section of the toner container 31A can be made larger than the vertical length when the toner cartridge 31 is viewed from the rotation axis direction of the rotary agitation members 32, i.e., a direction perpendicular to the paper face of FIG. 3.

The minimum interval between the rigid shaft members 32B of the two rotary agitation members 32 is a distance with which the flexible blade members 32C are mounted on the rigid shaft members 32B with a rotation phase difference of approximately 90° and with rotation trajectories designed to prevent a rigid shaft member 32B from interfacing an adjacent rigid shaft member 32B. The minimum interval is a distance of a dimension obtained by adding the radius of the rigid shaft members 32B to the radius of the circular rotation trajectories of the flexible blade members 32C. In a case where the flexible blade members 32C have the same configuration, the dimension ratio (aspect ratio) of the lateral width dimension of the inner wall of the toner container 31A to the vertical length can be 1.5:1. In this embodiment, a dimension ratio of (lateral width):(vertical length) of the inner wall of the toner container 31A of the toner cartridge 31 is defined as an aspect ratio. The aspect ratio can be set by setting the lateral width in a cross section of the toner container 31A to 1.5 times the diameter of the rotation trajectory of one flexible blade member 32C and setting the length in the vertical direction to one time the diameter of the rotation trajectory of one flexible blade member 32C.

Moreover, the maximum interval between rigid shaft members 32B of the two rotary agitation members 32 is a distance smaller than two times the radius of the rotation trajectories of the flexible blade members 32C in a state where the flexible blade members 32C are mounted on the rigid shaft members 32B with rotation phases different from each other by approximately 90°. The dimension ratio (aspect ratio) of the lateral width of the inner wall of the toner container 31A to the length in the vertical direction can be smaller than 2:1 when the flexible blade members 32C have the same configuration. The aspect ratio can be set by setting the lateral width of the toner container 31A to be smaller than two times the diameter of the rotation trajectory of one flexible blade member 32C and setting the length in the vertical direction to be one time the diameter of the rotation trajectory of one flexible blade member 32C. Since the interval between the rigid shaft members 32B of the two rotary agitation members 32 is set to a distance between the minimum distance and the maximum distance described above, it becomes possible to agitate toner efficiently in the toner container 31A and to transport toner to the toner transport screw 33.

The aspect ratio of the toner container 31A in a case where the rotary agitation members 32 have the same configuration is preferably within the range of 1.5:1 to 2:1. When the aspect ratio exceeds 2:1, a gap in the lateral direction between the two rotary agitation members 32 and the inner wall of the toner container 31A becomes large, and efficient toner agitation and efficient toner transport cannot be achieved. When the aspect ratio is smaller than 1.5:1, a gap between the inner wall in the vertical direction of the toner container 31A and tips of the flexible blade members 32C is increased. Here, when the aspect ratio is within the range of 1:1 to 1.5:1, it is possible to avoid lowering of the efficiency of toner agitation and toner transport in the toner cartridge 31 by the flexible blade members 32C.

As described above, capacity enlargement of the toner container 31A becomes possible since the lateral width of the inner wall of the toner container 31A is made larger than the vertical length when the toner cartridge 31 is viewed from the rotation axis direction of the rotary agitation members 32. Moreover, reduction in residual toner quantity at the time of replacement becomes possible since two rotary agitation members 32 are provided adjacent to each other and the toner container has a shape formed along the rotation trajectories 32G of the respective rotary agitation members 32. Moreover, capacity enlargement of the toner cartridge and downsizing of the toner cartridge become possible and effective utilization of an installation space becomes possible, since the two rotary agitation members 32 are placed with the rotation trajectories 32G overlapping each other and rotate with rotation phases shifted from each other, so as to prevent contact of the rotary agitation members 32 with each other.

The toner transport screw 33 to be located on the bottom face of the toner container 31A so as to supply toner from the toner discharge port to the development device is provided outside the rotation trajectories of the rotary agitation members 32 in order to avoid contact with the rotary agitation members 32. With such arrangement, a convex is formed at the external form of the toner cartridge 31 and a space is formed around the convex. In a case where a gap exists between the rotation trajectories 32G of the rotary agitation members 32 and the toner container 31A when the rotary agitation members 32 transport toner in the toner container 31A to the toner transport screw 33, toner remains in the gap area and the residual quantity at the time of toner cartridge replacement becomes large. When a gap between the rotation trajectories 32G of the rotary agitation members 32 and the toner container 31A is downsized in order to prevent such a state, the bottom face of the toner container 31A becomes semicircular and a dead space tends to be formed. However, since the toner transport screw 33 is placed in a space between the two rotation trajectories of the two rotary agitation members 32 and outside the rotation trajectories, it is possible to downsize a convex to be formed at the external form of the toner container 31A and it becomes possible to decrease a space around the convex. In this embodiment, since the toner transport screw 33 is placed on a bottom face of the toner container 31A between the rotation trajectories of the two rotary agitation members 32 as illustrated in FIG. 3, it becomes possible to reduce a wasteful space and to increase the toner containment capacity of the toner container 31A.

Figure 4A:
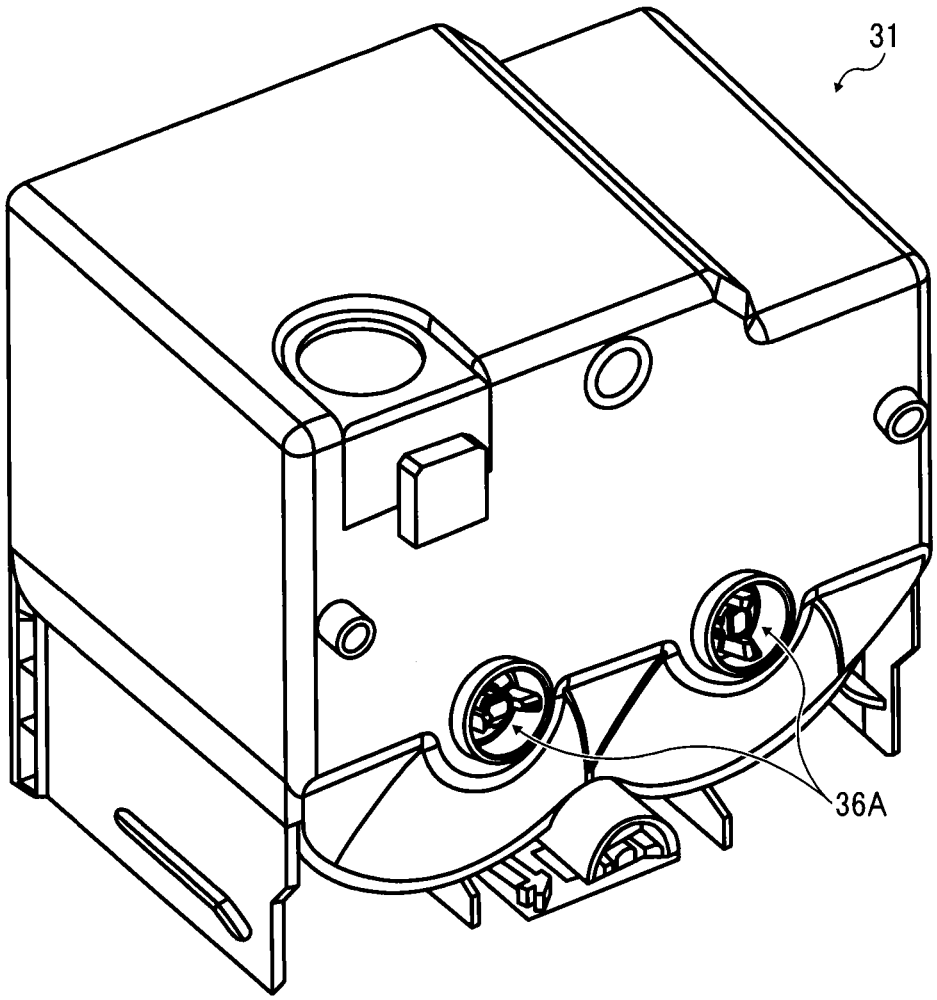
FIG. 4A is a perspective view of the toner cartridge.
Figure 4B:
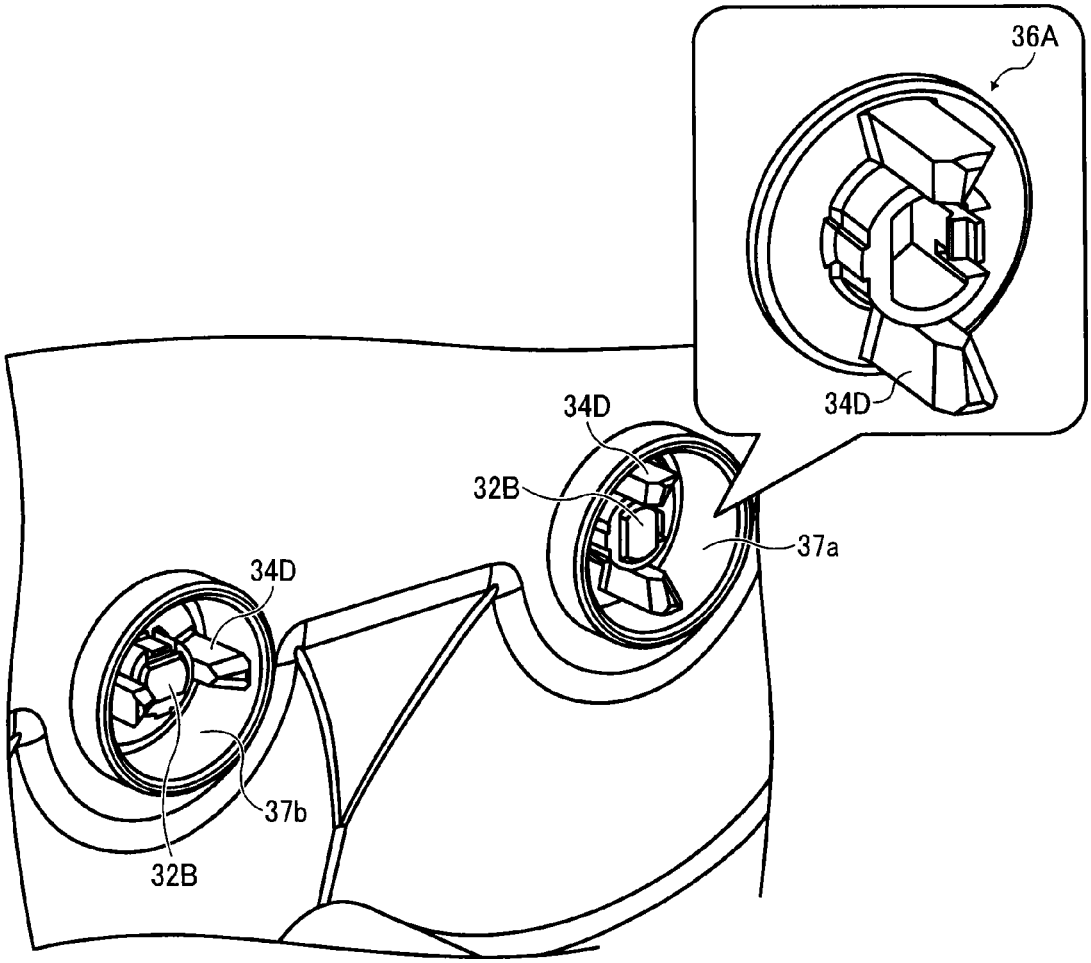
FIG. 4B is an enlarged view of joints of the toner cartridge.

FIGS. 4A and 4B are views of the toner cartridge 31 according to this embodiment viewed from a driving unit side. FIG. 4A is a perspective view, and an engagement member (a joint 36A) shaped as illustrated in FIG. 4A is attached to a tip of a rigid shaft member 32B of each rotary agitation member 32 (illustrated in FIG. 3) in order to receive transmission of driving. As illustrated in an enlarged view of FIG. 4B, each rigid shaft member 32B is provided with a joint 36A formed by erecting two claws 34D, which are projections at an interval of approximately 180°, so that driving force from a driving unit composed of a driving motor 35, which will be described later, and a gear train is transmitted via the claws 34D to the rotary agitation members 32.

Figure 5:
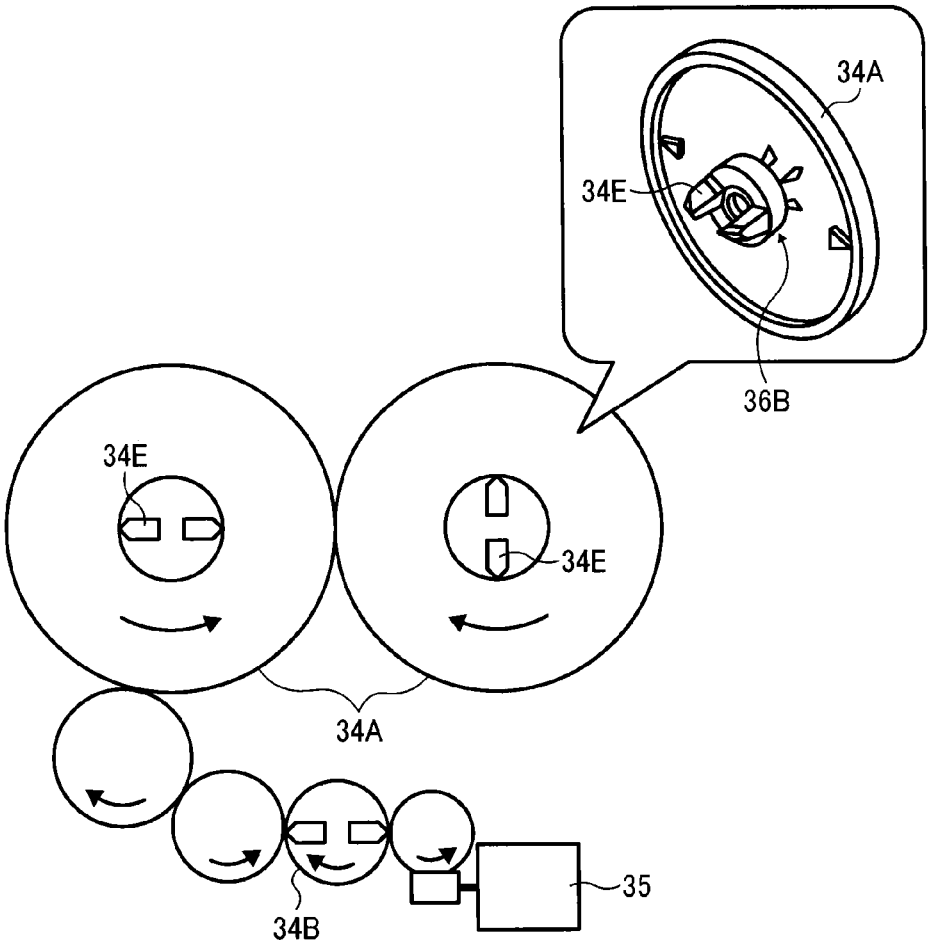
FIG. 5 is a schematic view of a driving unit of the image forming apparatus.

FIG. 5 is a view of a configuration of a driving unit to drive the toner cartridge 31. The driving unit is disposed at a toner cartridge setting member in the apparatus body 1 of the image forming apparatus. As illustrated in FIG. 5, the driving unit has a gear train structure in which gears configured to transmit driving force of the driving motor 35 as a driving source and adjust the rotation speed, one toner transport screw driving gear 34B, and two rotary agitation member driving gears 34A are engaged with each other. FIG. 5 illustrates an embodiment in which a driving unit includes a gear to decrease the number of revolution of the driving motor 35, the toner transport screw driving gear 34B, gears to transmit rotation to the rotary agitation member driving gears 34A, and the two rotary agitation member driving gears 34A. With a driving unit which uses a single driving motor 35 as a driving source, it becomes possible to decrease the number of components and to realize stable driving. In order to rotate the two rotary agitation members 32 in the same rotation direction, a gear for reversing is added between the two rotary agitation member driving gears 34A.

As illustrated in FIG. 5, each rotary agitation member driving gear 34A is also provided with an apparatus side engagement member (a joint 36B) formed by erecting two claws 34E at an interval of approximately 180° as a projection similar to the joint 36A of each rotary agitation member 32, so that driving force of the driving unit is transmitted via the claws 34E to the rotary agitation members 32. The two rotary agitation members rotate at the same rotation speed. The rotation phases of the claws 34E provided at the two rotary agitation member driving gears 34A are shifted from each other by approximately 90°.

Figure 6:
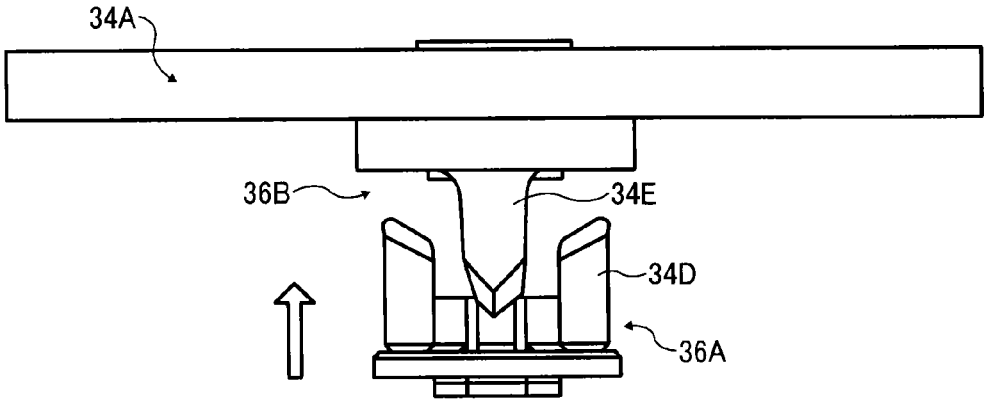
FIG. 6 is a schematic view of a joint of the driving unit.

When the toner cartridge 31 is set in the apparatus body 1 of the image forming apparatus, a joint of each rotary agitation member driving gear 34A of the driving unit to a rotary shaft 32B of each rotary agitation member 32 at a toner cartridge side has a positional relationship illustrated in FIG. 6. Here, when the rotary agitation member driving gear 34A rotates, the claw 34E extending from the rotary agitation member driving gear 34A starts to rotate. The two claws 34E, which are erected at an interval of approximately 180° as illustrated in FIG. 5, are different from gears that are always engaged with each other. That is, the rotary agitation member 32 starts to rotate when a claw 34E extending from the rotary agitation member driving gear 34A rotates and contacts with a claw 34D of a joint with the rotary agitation member 32.

Here, since the toner cartridge 31 according to this embodiment of this disclosure is placed with the rotation trajectories of the two rotary agitation members 32 partially overlapping each other as described above, blades of the flexible blade members 32C may possibly interfere and collide with each other depending on an initial state of the rotary agitation members 32 inside the toner cartridge. More specifically, a claw 34E extending from a rotary agitation member driving gear 34A may contact with a claw 34D of a joint 36A attached to a rigid shaft member 32B provided with a rigid frame member 32A positioned at a lower side in a state where a rigid frame member 32A of one rotary agitation member 32 is positioned at a place lower than a rigid frame member 32A of the other rotary agitation member 32, and only the rotary agitation member 32 positioned at a lower side may start rotating. In such a case, the rotary agitation member 32 positioned at a lower side collides with and interferes with the rigid frame member 32A of the rotary agitation member 32 positioned at an upper part, and rotation is obstructed. The positional relationship of the rotary agitation members 32 described above appears when pressing force is applied to the claws 34D in a state where toner is stored and the positions of the claws 34D are changed, or when the rotary agitation members 32 are pushed by toner being refilled and refill is completed in a state where the rotary agitation members 32 have the positional relationship described above.

Therefore, in order to prevent such a situation, a holding member which defines the positions of the claws 34D described above is mounted before toner is refilled. Alternatively, the positions of the claws 34D may be adjusted after toner refill, and a holding member may be mounted so that the positions of the claws 34D are not changed.

Figure 7:
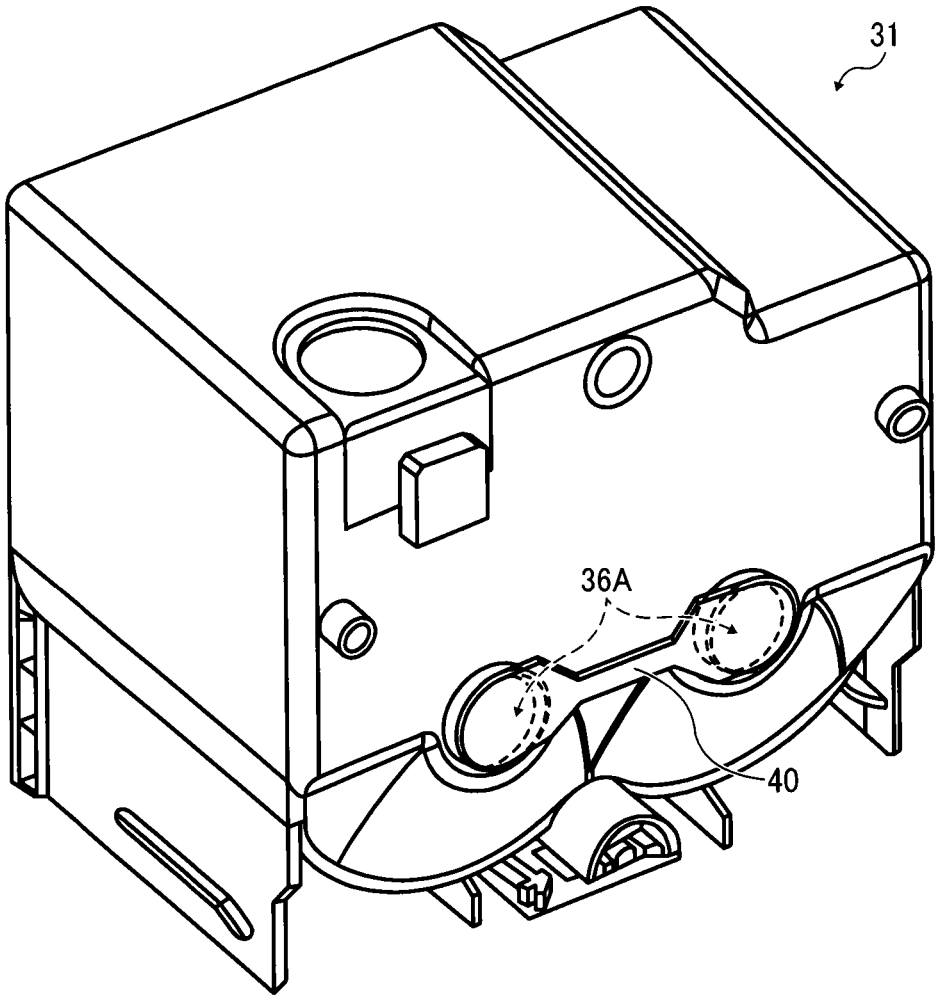
FIG. 7 is a view of a mounting state of a holding member.
Figure 8:
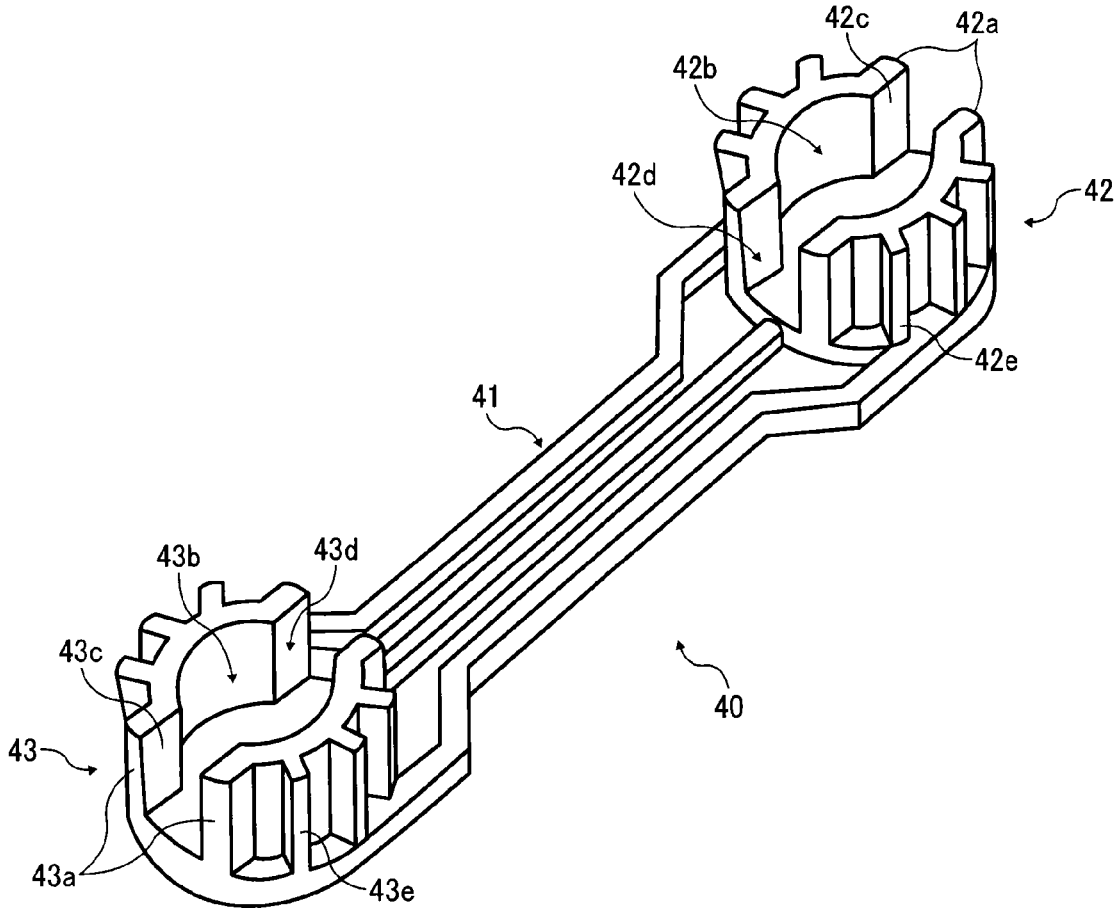
FIG. 8 is a perspective view of a configuration of the holding member.
Figure 9A:
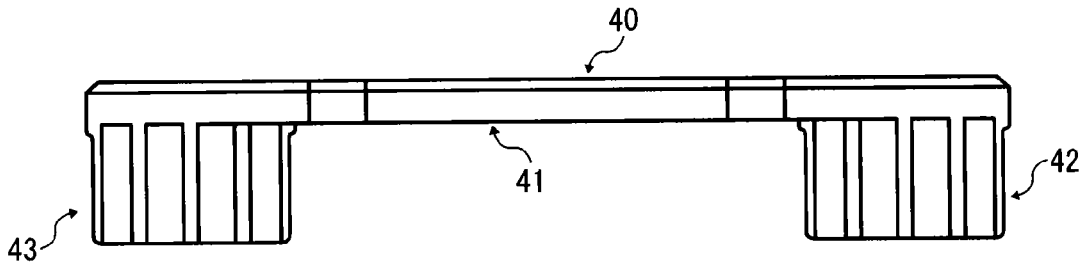
FIG. 9A is a side view of the holding member of FIG. 8.
Figure 9B:
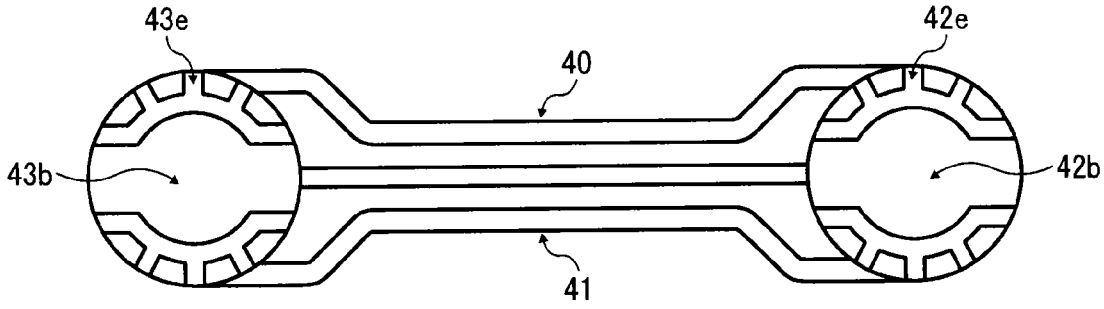
FIG. 9B is a bottom view of the holding member of FIG. 8.

FIGS. 7, 8, 9A and 9B each are views of an embodiment of this disclosure, and are views of the mounting state of a holding member 40 which defines the positions of the claws 34D in the joints 36A of the rotary agitation members 32, and a configuration of the holding member 40. FIG. 7 is a view of a state where the holding member 40 is mounted to circular openings 37*a* and 37*b* in the vicinity of the joints 36A of the toner cartridge 31. FIG. 8 is a perspective view of a configuration of the holding member 40. FIGS. 9A and 9B are a side view and a bottom view, respectively, of a configuration of the holding member 40.

The holding member 40 is composed of a first claw holding part 42 and a second claw holding part 43 which are formed with resin and configured to respectively hold the two claws 34D of the toner cartridge 31, and a connecting part 41 configured to connect the first claw holding part 42 and the second claw holding part 43. Although the following description will explain only the first claw holding part 42, the second claw holding part 43 has the same configuration, and a member having a configuration equal to a member 42*a* of the first claw holding part 42 will be indicated by a reference sign 43*a*, for example, in FIGS. 8, 9A and 9B. The first claw holding part 42 is formed with a pair of projecting walls 42*a* to be inserted into the circular opening 37*a* illustrated in FIG. 4B in which the joint 36A of the toner cartridge 31 is provided. The projecting walls 42*a* are provided with reinforcement ribs 42*e* extending radially outward. FIG. 7 illustrates a state where the holding member 40 is mounted to the joints 36A of the toner cartridge 31. The holding member 40 is mounted to the toner cartridge 31 by engaging the outer circumference of the reinforcement ribs 42*e* in the inner circumference of the circular opening 37*a*. Regarding the second claw holding part 43, the holding member 40 is also mounted integrally to the toner cartridge 31 by engaging the outer circumference of the reinforcement ribs 43*e* in the circular opening 37*b*.

The holding member 40 is provided, between a pair of projecting walls 42*a*, with a claw receiving portion 42*d* which receives the claws 34D, and a shaft receiving portion 42*b* which receives a central part of the joint 36A, when the holding member 40 is inserted into the circular opening 37*a*. The claw receiving portion 42*d* is provided with a claw movement regulating portion 42*c* formed by opposed wall faces of a pair of the projecting walls 42*a*. The claw movement regulating portion 42*c* is provided at two positions with the shaft receiving portion 42*b* sandwiched therebetween, and opposed wall faces of a pair of projecting walls 42*a* extend parallel to a line which connects the first claw holding part 42 and the second claw holding part 43.

Since the claw movement regulating portion 42*c* has the above configuration, when the claws 34D received by the claw receiving portion 42*d* start moving in the rotation direction, the claws 34D collide with opposed faces of the projecting walls 42*a* of the claw movement regulating portion 42*c*, so that the movement is regulated. Moreover, since opposed wall faces of the projecting walls 42*a* of the claw movement regulating portion 42*c* are formed parallel to the line which connects the first claw holding part 42 and the second claw holding part 43 and this is the common configuration for the first and second claw holding parts, the respective claws 34D in the toner cartridge 31 received by the claw receiving portion 42*d* of the first claw holding part 42 and by a claw receiving portion 43*d* of the second claw holding part 43 are maintained to face the same direction (so as to be aligned in a line substantially parallel to the line which connects the first claw holding part 42 and the second claw holding part 43). Here, in this embodiment, the positional relationship of the claws 34D and the rotary agitation member 32 is set so that the rotary agitation member 32 extends in the vertical direction when the claws 34D are received by the claw receiving portion 42*d* and the above state is obtained. Accordingly, both of the flexible blade members 32C of the two rotary agitation members 32 extend in the vertical direction in a state where the holding member 40 is mounted to the toner cartridge 31.

In such a setting, when any flexible blade member 32C is kept horizontal in refill of toner from an upper part of the toner cartridge 31, toner may possibly accumulate at a place of the flexible blade member 32C except the openings 32D or become a state such as a cover. However, in this embodiment, since each flexible blade member 32C of the rotary agitation member 32 is provided with the openings 32D, toner tends to pass through the openings 32D of each flexible blade member 32C during refill of toner from an upper part of the toner cartridge 31 and be refilled uniformly into the toner cartridge 31.

The shaft receiving portion 42*b* has arcuate wall faces opposed to each other, so that a center part of the joint 36A can be received by the shaft receiving portion 42*b*.

The connecting part 41 has a tabular form, is formed integrally with the first claw holding part 42 and the second claw holding part 43, and connects the first claw holding part 42 and the second claw holding part 43. The connecting part 41 disables independent rotation of the first claw holding part 42 and the second claw holding part 43, and the positions of the claws 34D are regulated when the first claw holding part 42 and the second claw holding part 43 are inserted into the circular openings 37*a* and 37*b* provided with the joints 36A of the toner cartridge 31. Since the connecting part 41 connects the first and second claw holding parts to each other, it becomes possible to regulate the positions of the respective claws 34D with a simple configuration.

That is, in this embodiment, the holding member 40 having the following configuration is mounted to the joints 36A of the toner cartridge 31 so as to prevent rotation of the two rotary agitation members 32 from interfacing each other. The holding member 40 is provided with a plurality of claw receiving portions 42*d* and 43*d* configured to receive a plurality of claws 34D of the joints 36A provided at the toner cartridge 31, and claw movement regulating portions 42*c* and 43*c* which are provided at the plurality of claw receiving portions 42*d* and 43*d* and configured to regulate movement of the plurality of claws 34D in the rotation direction. The plurality of claw receiving portions 42*d* and 43*d* are connected to each other by the connecting part 41.

That is, this embodiment is characterized in that the holding member 40 is mounted to the joints 36A of the toner cartridge 31 so as to prevent rotation of the two rotary agitation members 32 from interfacing each other, the holding member 40 is provided with a plurality of claw receiving portions 42*d* and 43*d* configured to receive a plurality of claws 34D provided at the toner cartridge 31, and the claw movement regulating portions 42*c* and 43*c* which are provided at the plurality of claw receiving portions 42*d* and 43*d* and configured to regulate movement of the plurality of claws 34D in the rotation direction, and the plurality of claw receiving portions 42*d* and 43*d* are connected to each other by the connecting part 41.

It is to be noted that the holding member 40 is not limited to the above configuration, and the claw movement regulating portions 42*c* and 43*c* may be formed not of opposed wall faces but of one wall face, or the connecting part 41 may be provided independently and connected to the claw holding parts 42 and 43 so as not to be movable. Furthermore, the two rotary agitation members 32 do not need to extend parallel to the vertical direction in a state where the claws 34D of the joints 36A are fixed by the holding member 40, as long as the two rotary agitation members are held not to interfere each other during rotation.

Moreover, after the holding member 40 is mounted to the toner cartridge 31, an attachment member is attached to the connecting part 41 to fix the holding member 40 to the toner cartridge 31. For example, a member having small attachment force may be used as the attachment member so as to facilitate attachment and detachment. An attachment sheet having a sheet form, for example, is attached to cover the connecting part 41 of the holding member 40 so as to fix the holding member 40, which is mounted to the joints 36A of the toner cartridge 31, to an external wall of the toner cartridge 31. Since the attachment member is attached to the connecting part 41 of the holding member 40, it becomes possible to fix the holding member 40 to the toner cartridge 31 in an easy way.

Figure 10:
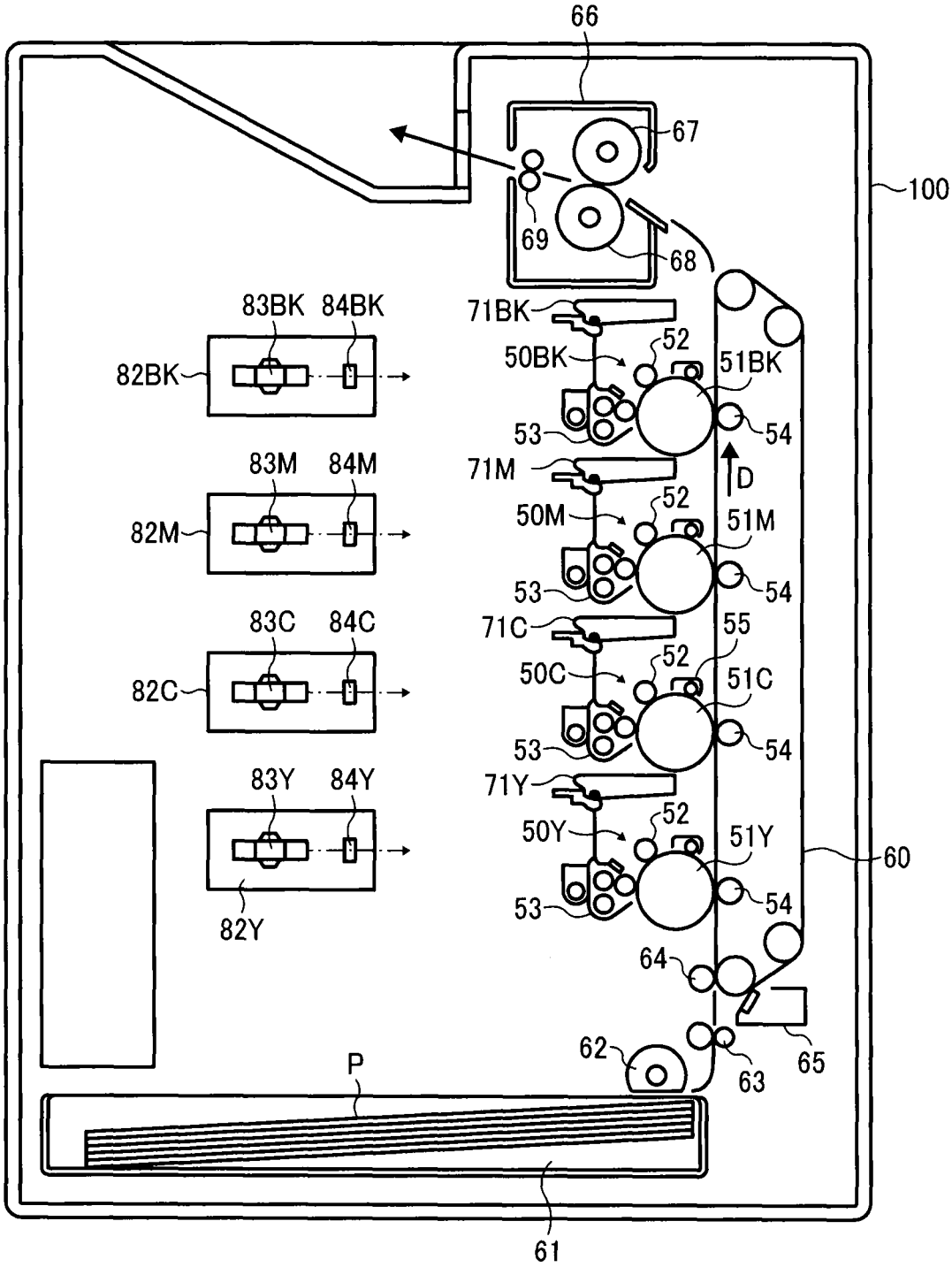
FIG. 10 is a schematic view of an image forming apparatus according to an embodiment of the present disclosure.

FIG. 10 is a schematic view of a basic configuration of an image forming apparatus, serving as an electrophotographic printer, according to another embodiment of this disclosure.

The image forming apparatus according to this embodiment has a configuration similar to the image forming apparatus illustrated in FIG. 1, except that the image forming apparatus is an image forming apparatus of a vertical type in which the respective components are placed in a direction perpendicular to the installation face of an apparatus body 100 of the image forming apparatus. The printer is a tandem type color printer, which is provided with an independent optical scanning system and an image bearing body for each color component of yellow, cyan, magenta and black, and carries out multiplex printing to an intermediate transfer body and transfer onto a sheet P serving as a recording material so as to obtain color print.

A writing unit 82 (a general term of 82BK, 82M, 82C and 82Y) is a device configured to write an electrostatic latent image on a photoreceptor drum 51 (a general term of 51BK, 51M, 51C and 51Y) (an image bearing body) on the basis of image information after a charging process. The writing unit 82 is an optical scanning device which uses a polygon mirror 83 (a general term of 83BK, 83M, 83C and 83Y), an optical element 84 (a general term of 84BK, 84M, 84C and 84Y) and the like. It is to be noted that an LED array can be used as the writing unit instead of an optical scanning device.

A sheet feeding unit 61 stores a sheet P such as a recording sheet or an OHP as a transfer object material, and feeds the sheet P toward a transfer belt 60 for image formation. The transfer belt 60 is an endless belt to be used for conveying the sheet P attached to the surface thereof electrostatically and transferring a toner image, which is formed on the photoreceptor drum 51, onto the sheet P, and is provided with an attachment roller 64 and a belt cleaner 65 on the outer circumference thereof.

A transfer roller 54, which is opposed to each photoreceptor drum 51 with the transfer belt 60, has a metal core and a conductive elastic layer to be used for covering the metal core. The conductive elastic layer of the transfer roller 54 is an elastic body in which a conductive imparting agent such as carbon black, zinc oxide or tin oxide is mixed and dispersed in an elastic member such as polyurethane elastomer or ethylene-propylene-diene polyethylene (EPDM) and electrical resistivity (volume resistivity) is adjusted to middle resistance.

A fixing unit 66 has a heating roller 68 and a pressing roller 67, and fixes a toner image on the sheet P to the sheet P with pressure and heat.

Four process cartridges 50Y, 50C, 50M and 50BK disposed in a vertical direction along the transfer belt 60 are used respectively for forming toner images of yellow, cyan, magenta and black. The respective process cartridges 50Y to 50BK are provided with toner cartridges 71Y, 71C, 71M and 71BK, serving as supply members configured to supply toner (toner particles) of each color (yellow, cyan, magenta or black) and carriers (magnetic carriers) to the development device 53.

The process cartridge 50 (a general term of 50Y, 50C, 50M and 50BK) and the toner cartridge 71 (a general term of 71Y, 71C, 71M and 71BK) are detachably mounted to the apparatus body.

The image forming apparatus according to this embodiment is a composite type image forming apparatus serving as a copier and a printer. When the image forming apparatus functions as a copier, various image processes such as analog/digital (A/D) conversion, modulation transfer function (MTF) compensation or a gradation process are performed on image information read by a scanner, and the image information is converted into write data. When the image forming apparatus functions as a printer, image processes are performed to image information in a format such as page description language or bitmap to be transmitted from a computer or the like, and the image information is converted into write data.

For image formation, the writing unit 82 irradiates the process cartridge 50 with exposure light corresponding to image information of black, magenta, cyan or yellow. That is, exposure light (a laser beam) emitted from each light source passes through the polygon mirror 83, the optical element 84 and the like, and each photoreceptor drum 51 is irradiated with the exposure light. In such a manner, a toner image corresponding to the exposure light is formed on the photoreceptor drum 51 (an image bearing body) of each process cartridge 50. In addition, the toner image is transferred onto a sheet P. A sheet P, which is fed from the sheet feeding unit 61, is conveyed to the position of the transfer belt 60 while matching the timing once at the position of a registration roller 63. The attachment roller 64, which is disposed at an entry position of the transfer belt 60, attaches a sheet P by application of voltage, to the transfer belt 60. The sheet P moves with running of the transfer belt 60 in a direction indicated by arrow D and sequentially passes through the positions of the respective process cartridges 50. Toner images of the respective colors are transferred one on another.

The sheet P, onto which a color toner image has been transferred, is separated from the transfer belt 60 and reaches the fixing unit 66. The toner image on the sheet P serving as a transfer target material is heated while being sandwiched with the heating roller 68 and the pressing roller 67, and is fixed onto the sheet P. Meanwhile, after separation of the sheet P, the surface of the transfer belt 60 reaches the position of the belt cleaner 65, and dirt such as toner adhering to the surface of the transfer belt is cleaned with the belt cleaner 65.

The process cartridge 50 includes, as an integral unit, the photoreceptor drum 51 serving as an image bearing body, a charging unit 52, a development device 53 (a development unit), and a cleaning unit 55. The process cartridge 50 employs a premix developing method (a developing method of refilling and discharging carriers suitably).

The photoreceptor drum 51 serving as an image bearing body is a negatively charged organic photoreceptor and is driven to rotate in a counterclockwise direction in FIG. 10 by a rotation driving mechanism.

The charging unit 52 is an elastic charging roller which is obtained by forming a urethane foam layer, which includes urethane resin, carbon black that functions as conductive particles, a sulfurizing agent, a foaming agent or the like and has middle resistance, into a roller shape on a metal core. Used as the material of a middle resistance layer of the charging unit 52 is urethane, ethylene-propylene-diene polyethylene (EPDM), butadiene-acrylonitrile rubber (NBR) or silicone rubber. Moreover, a rubber material obtained by dispersing a conductive substance such as carbon black or metallic oxide in isoprene rubber or the like as the material of a middle resistance layer in order to adjust resistance, or a foamed material thereof can also be used.

The cleaning unit 55 is provided with a cleaning brush (or a cleaning blade) which contacts slidingly with the photoreceptor drum 51, so that non-transferred toner on the photoreceptor drum 51 is removed and recovered mechanically.

In the development device 53, a development roller 53*a* serves as a developer bearing body is disposed adjacent to the photoreceptor drum 51. A development area in which the photoreceptor drum 51 and a magnetic brush contact with each other is formed at opposed parts of the development roller 53*a* and the photoreceptor drum 51. Developer (two-component developer) composed of toner and carriers is housed in the development device 53. In addition, the development device 53 develops an electrostatic latent image formed on the photoreceptor drum 51 (forms a toner image).

The toner cartridge 71 houses developer (toner and carriers) to be supplied into the development device 53. In addition, the toner cartridge 71 functions as a supply member configured to supply new toner to the development device 53 and also supply new carriers to the development device 53. More specifically, the toner cartridge 71 supplies developer toward inside of the development device 53 suitably on the basis of information of the toner density (ratio of toner in developer) detected by a magnetic sensor or the like located in the development device 53.

Next, an imaging process to be performed on the photoreceptor drum 51 will be described.

When the photoreceptor drum 51 is driven to rotate in the counterclockwise direction, the surface of the photoreceptor drum 51 is first charged uniformly at the position of the charging unit 52. The charged surface of the photoreceptor drum 51 then reaches the irradiation position of exposure light and an exposure process is performed by the writing unit 82. That is, by neutralizing the surface of the photoreceptor drum 51 selectively in accordance with image information by irradiation with exposure light so as to generate a difference (potential contrast) from the potential of a non-image part which has not been irradiated, an electrostatic latent image is formed. It is to be noted that, in the exposure process, a charge generating substance receives light in a photosensitive layer of the photoreceptor drum 51 and generates a charge, and holes thereamong and electrification charges on the surface of the photoreceptor drum 51 cancel each other. The surface of the photoreceptor drum 51, on which a latent image has been formed, then reaches a position opposed to the development device 53. The electrostatic latent image on the photoreceptor drum 51 contacts with a magnetic brush on the development roller 53*a*, and negatively charged toner in the magnetic brush adheres to the electrostatic latent image, so that the image is visualized.

The surface of the photoreceptor drum 51, on which a toner image has been formed, then reaches a position opposed to the transfer belt 60 and the transfer roller 54. In addition, a toner image on the photoreceptor drum 51 is transferred onto a sheet P, which has been conveyed to the opposed position according to the timing. At this time, a predetermined voltage is applied to the transfer roller 54. The sheet P, onto which a toner image has been transferred, then passes through the fixing unit 66 and is discharged from a discharge roller 69 to outside of the apparatus.

On the other hand, toner (non-transferred toner), which has not been transferred to the sheet P in the transfer step and remains on the photoreceptor drum 51, remains adhering on the photoreceptor 51 and reaches a part opposed to the cleaning unit 55. Non-transferred toner on the photoreceptor drum 51 is then removed and recovered by the cleaning unit 55. The surface of the photoreceptor drum 51 then passes through a neutralization member, and a series of imaging processes at the photoreceptor drum 51 terminates.

The configuration of the toner cartridge 71 according to this embodiment will be described with reference to FIGS. 11 and 12.

The respective toner cartridges 71Y, 71C, 71M and 71BK have the same configuration except that toner of different colors is used. FIGS. 11 and 12 are cross-sectional views of the toner cartridge 71.

The toner cartridge 71 has a toner container 71A which is a toner containing member to be filled with toner, a toner transport screw 72 serving as a toner transport member installed in the toner container 71A, and three rotary agitation members 73A, 73B1 and 73B2. The three rotary agitation members 73A, 73B1 and 73B2 agitate toner by rotating integrally around rigid shaft members 73AB, 73B1B and 73B2B serving as rotation shafts disposed parallel to the toner transport screw 72 in the toner container 71A. The inner bottom wall of the toner container 71A may have arc-shaped portions along rotation trajectories of the two rotary agitation members 73B1 and 73B2. The rotary agitation member 73A receives rotational driving force and is driven to rotate, and shafts of the rotary agitation members 73B1 and 73B2 are respectively supported on the toner container 71A so that the members become rotatable.

The three rotary agitation members 73A, 73B1 and 73B2 are provided to agitate toner in the toner container 71A and transport toner to the toner transport screw 72 (a toner transport member). The rotary agitation member 73A has the rigid shaft member 73AB and a blade member 731A which is constituted of a flexible blade member attached to a terminal of a rigid frame member and a rigid frame member formed integrally with the rigid shaft member. The blade member 731A may have no flexible blade member, or may be shaped to have an extremely small length. The blade member 731A is formed to have a rotation trajectory which has the rigid shaft member 73AB as a center, and is formed in a two-blade form in which two blades are provided at an interval of 180° so as to protrude bidirectionally from the rigid shaft member 73AB to be axisymmetric with respect to a direction perpendicular to the axis of the rigid shaft member 73AB. Alternatively, the rotary agitation member 73A may be formed in a three-blade form in which the blade members 731A protrude in three directions from the rigid shaft member 73AB. The rotary agitation member 73A may have a multi-blade form having three blades or more. The rigid frame member of the blade member 731A is provided with openings, so that toner can pass through the openings.

The rotary agitation members 73B1 and 73B2 can have similar configurations. The rotary agitation member 73B1 has a rigid shaft member 73B1B and the blade member 731B1 which is constituted of a flexible blade member attached to a terminal of the rigid shaft member and a rigid frame member integrated with the rigid shaft member. Similarly, the rotary agitation member 73B2 also has the rigid shaft member 73B2B and a blade member 731B2. The blade members 731B1 and 731B2 may have no flexible blade member, or may be shaped to have an extremely small length.

The blade member 731B1 is formed to have a rotation trajectory which has the rigid shaft member 73B1B as a center, and is formed in a four-blade form in which four blades are provided at an interval of 90° so as to protrude in four directions from the rigid shaft member 73B1B to be axisymmetric with respect to a direction perpendicular to the axis of the rigid shaft member 73B1B. The rigid frame member of the blade member 731B1 is provided with openings, so that toner can pass through the openings. Similar to the blade member 731B1, the blade member 731B2 also has the configuration of the rigid shaft member 73B2B. The length of the blade member 731B1 and the blade member 731B2 can be set so that the edges contact with the inner bottom wall of the toner container 71A during rotation. When the blade member 731B1 and the blade member 731B2 rotate with the edges being in contact with the inner bottom wall of the toner container 71A, it is possible to scrape out adhering toner and an effect that residual toner decreases is obtained.

Although it is preferable that rigid shaft members and blade members of the rotary agitation members 73*a*, 73B1 and 73B2 are integrally formed with metal or resin, other materials or other manufacturing methods may be employed. Flexible blade members of the blade members are formed with a material having low rigidity, e.g., flexible members such as polyethylene-terephthalate (PET), polyethylene (PE), polypropylene (PP), polyphenylene sulfide (PPS) or a polyurethane sheet. It is preferable that the thickness is approximately 50 μm to approximately 500 μm, and it is especially suitable that the thickness is 50 μm to 300 μm. Since the flexible blade members of the blade members are flexible, rotation of the flexible blade members is not obstructed even in a state where the tips are in contact with the inner bottom wall of the toner container 71A.

The toner cartridge 71 houses toner T in the toner container 71A, and is provided with a discharge port 74 of toner T, the toner transport screw 72 constituted of a spiral screw configured to transport toner T to the discharge port 74, and the rotary agitation members 73A, 73B1 and 73B2. The rotary agitation members 73A, 73B1 and 73B2 transport toner T in the toner container 71A to the toner transport screw 72.

The discharge port 74 is configured to supply toner for refill corresponding to each color from the discharge port 74 via a toner transport path to each development device 53 which stores yellow, cyan, magenta or black toner when toner decreases.

The rotary agitation members 73A, 73B1 and 73B2 are provided respectively with a plurality of blade members 731A, 731B1 and 731B2, and the toner transport screw 72 is located at a place lower than the rotary agitation members 73A and 73B in a direction perpendicular to the installation face of the apparatus body 100 of the image forming apparatus. That is, the toner transport screw 72 is placed at a bottom face side of the toner container 71A. The toner transport screw 72 and the rotary agitation member 73A are driven by a common driving source (a motor) of the apparatus body 100 via a rotary agitation member driving gear 75A and a toner transport screw driving gear 75B illustrated in FIG. 12.

In this embodiment, the rotary agitation member 73A receives rotational driving force from the apparatus body 100 of the image forming apparatus and is driven to rotate. The two rotary agitation members 73B1 and 73B2 are located at positions to interfere and contact with a rotation trajectory of the blade member 731A of the rotary agitation member 73A. When the rotary agitation member 73A rotates, a part of the rotation trajectory of the blade member 731A interferes with a part of a rotation trajectory of each of the two blade members 731B1 and 731B2 of the two rotary agitation members 73B1 and 73B2, so as to rotate the two rotary agitation members 73B1 and 73B2.

Figure 11:
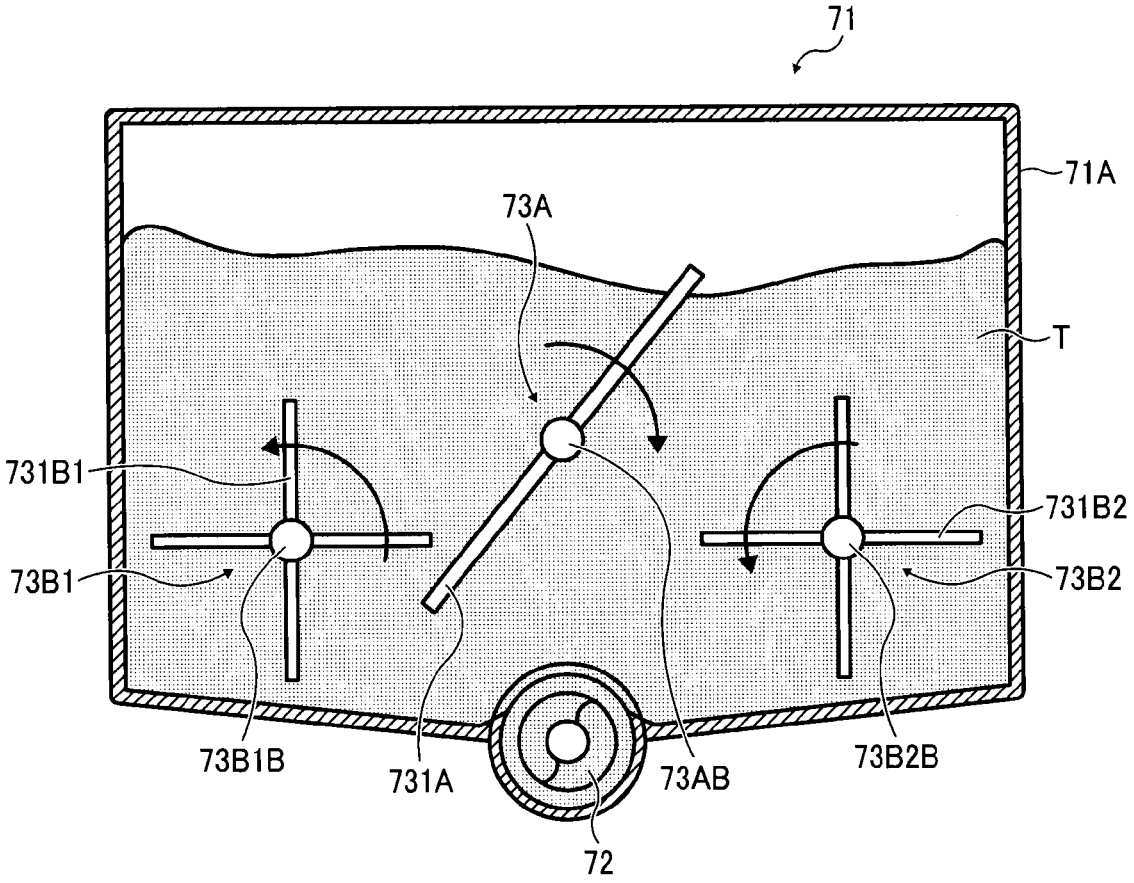
FIG. 11 is a cross-sectional view of a toner cartridge according to an embodiment of the present disclosure.
Figure 12:
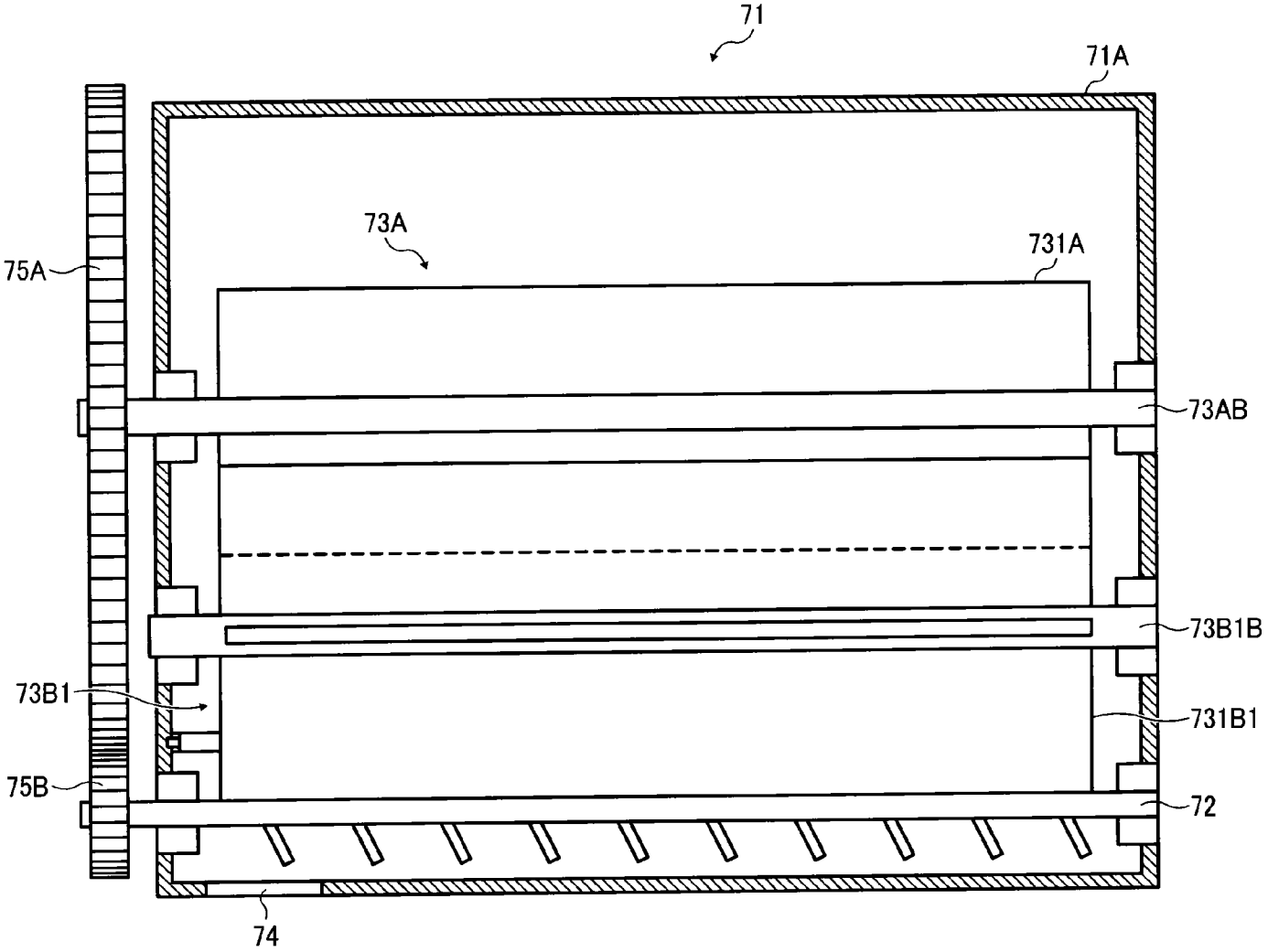
FIG. 12 is a cross-sectional view of the toner cartridge of FIG. 11.

In the case of a laterally long toner container 71A illustrated in FIG. 11, the blade member 731A needs to be provided with a long elastic member such as a flexible blade member in order to transport toner at right and left ends of the toner container 71A to the toner transport screw 72 with only one rotary agitation member 73A. In a case where a long elastic member is used, however, a gap between the blade part 731A and the bottom face of the toner container 71A is downsized when the long elastic member is left in a position perpendicular to the installation face of the apparatus body 100 in the rotation direction of the rotary agitation member 73A for a long time. Accordingly, an elastic member of the blade member 731A of the rotary agitation member 73A is deformed at the time of initiation of rotary agitation to toner or the like, and it becomes hard to transport toner at the right and left ends of the toner container 71A to the toner transport screw 72. Moreover, it is necessary to provide a number of idler gears or joint members in a case where rotational driving is given from the apparatus body 100 respectively to a plurality of located rotary agitation members 73B1 and 73B2.

In this embodiment, toner at the right and left ends of the toner container 71A can be transported to the toner transport screw 72 with the two rotary agitation members 73B1 and 73B2. Even an elastic member is provided in the rotary agitation members 73B1 and 73B2, a gap between the rotary agitation members and the toner container 71A does not change in the rotation direction, and therefore a phenomenon of decrease in transport of toner by deformation of the elastic member does not occur. Moreover, since the two rotary agitation members 73B1 and 73B2 are rotated by rotational driving of the rotary agitation member 73A, it becomes possible to reduce the number of idler gears or joint members Moreover, in this embodiment, the rotary agitation member 73A configured to receive rotation power from the apparatus body 100 for rotation is located substantially at the central position of the plurality of located rotary agitation members 73B1 and 73B2. When the blade member 731A of the rotary agitation member 73A interferes with the blade members 731B1 and 731B2 of the rotary agitation members 73B1 and 73B2 to rotate the rotary agitation members 73B1 and 73B2, stress is generated at the blade members 731A, 731B1 and 731B2. In this embodiment, since the rotary agitation member 73A is located substantially at the central position of the plurality of located rotary agitation members 73B1 and 73B2, stress to be applied to the blade member 731A can be dispersed.

In this embodiment, the toner container 71A is placed in a direction perpendicular to the installation face of the apparatus body 100, and toner at right and left ends of the toner container 71A can be transported to the toner transport screw 72 even in a laterally long shape parallel to the installation face. Accordingly, it becomes possible to decrease the residual toner quantity in the toner container 71A. Since the residual toner quantity in the toner container 71A is decreased, it becomes possible to downsize the toner container 71A at least by the amount of decrease in residual toner quantity. It becomes possible to downsize the toner cartridge 71.

It is to be noted that the image forming apparatus illustrated in FIG. 10 is an embodiment in which the plurality of toner cartridges 71 are placed inside the apparatus body 100 in a direction perpendicular to the installation face so as to correspond to the respective development devices 53. The toner cartridge 71 can be placed at an upper part of the image forming apparatus 1 as is the case of the toner cartridge 31 of the image forming apparatus 1 illustrated in FIG. 1.

As described above, for a toner cartridge according to at least one embodiment of this disclosure, by providing two rotary agitation members to be placed adjacent to each other in one toner container with rotation trajectories thereof partially overlapping each other, a lateral width of an inner wall of the toner container viewed from a rotation axis direction of the rotary agitation members is increased to a range larger than one time and smaller than two times the vertical length. This provides excellent advantages that capacity enlargement of the toner container can be achieved and the toner cartridge can be downsized.

Numerous additional modifications and variations are possible in light of the above teachings. It is therefore to be understood that, within the scope of the above teachings, the present invention may be practiced otherwise than as specifically described herein. With some embodiments having thus been described, it will be obvious that the same may be varied in many ways. Such variations are not to be regarded as a departure from the scope of the present invention and appended claims, and all such modifications are intended to be included within the scope of the present invention and appended claims. For example, an image forming apparatus according to an embodiment of the present invention is not limited to the above-described type of image forming apparatus but may be any other type of image forming apparatus. The advantages of the above-described embodiments of this disclosure are examples of most preferable advantages obtained from the embodiments, and the advantages of the present invention is not limited to the advantages described in the above-described embodiments.

What is claimed is:

1. A toner cartridge, comprising:

a toner container to store toner;

two rotary agitation members to rotate to agitate toner in the toner container, the rotary agitation members each having a rotational axis; and a discharge port to discharge the toner from the toner cartridge, the toner being discharged in a direction which is perpendicular to the rotational axes of the rotary agitation members, wherein the toner container has two arc-shaped portions adjacent to each other at an inner bottom wall of the toner container, the two rotary agitation members have edges to rotate along the two arc-shaped portions with rotation phases thereof shifted from each other, and the two rotary agitation members are placed with rotation trajectories thereof partially overlapping each other.

2. The toner cartridge according to claim 1, further comprising a driving unit to rotate the two rotary agitation members with the rotation phases shifted from each other by approximately 90°.

3. The toner cartridge according to claim 1, wherein a dimension ratio of a lateral width to a vertical length of an inner wall of the toner cartridge in a cross section perpendicular to an axial direction of a rotation shaft of each of the two rotary agitation members is more than 1:1 and smaller than 2:1.

4. The toner cartridge according to claim 1, wherein the two rotary agitation members rotate in directions different from each other.

5. The toner cartridge according to claim 1, wherein the two rotary agitation members have an identical configuration.

6. The toner cartridge according to claim 1, further comprising a first joint disposed at a tip of each of the rotary agitation members to engage a second joint disposed at each of rotary agitation member driving gears to drive the respective rotary agitation members, wherein each of the first joint and the second joint has two projections erected at an interval of approximately 180° and transmits power of a driving source from each of the rotary agitation member driving gears to a corresponding one of the rotary agitation members via the projections.

7. The toner cartridge according to claim 6, wherein the two rotary agitation member driving gears have rotation phases shifted from each other by approximately 90°.

8. The toner cartridge according to claim 1, wherein the two rotary agitation members rotate at an identical rotation speed.

9. The toner cartridge according to claim 1, further comprising a toner transport member to transport toner toward the toner discharge port, wherein the toner transport member is disposed in a space between two rotation trajectories of the two rotary agitation members and outside the rotation trajectories.

10. The toner cartridge according to claim 9, wherein the toner transport member and the two rotary agitation members are connected to a common driving motor via a gear train.

11. An electrophotographic image forming apparatus, comprising a toner cartridge, the toner cartridge including a toner container to store toner;

two rotary agitation members to rotate to agitate toner in the toner container the rotary agitation members each having a rotational axis; and a discharge port to discharge the toner from the toner cartridge, the toner being discharged in a direction which is perpendicular to the rotational axes of the rotary agitation members, wherein the toner container has two arc-shaped portions adjacent to each other at an inner bottom wall of the toner container, the two rotary agitation members have edges to rotate along the two arc-shaped portions with rotation phases thereof shifted from each other, and the two rotary agitation members are placed with rotation trajectories thereof partially overlapping each other.

* * * * *